US012723498B2

(12) United States Patent
Brown

(10) Patent No.: US 12,723,498 B2
(45) Date of Patent: Sep. 1, 2026

(54) VENTURI CONTROLLED UNLOADING VALVE FOR GAS LIFT SYSTEM

(71) Applicant: Baker Hughes Oilfield Operations LLC, Houston, TX (US)

(72) Inventor: Donavan Brown, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 19/101,139

(22) PCT Filed: Apr. 14, 2023

(86) PCT No.: PCT/US2023/018723
§ 371 (c)(1),
(2) Date: Feb. 4, 2025

(87) PCT Pub. No.: WO2024/215338
PCT Pub. Date: Oct. 17, 2024

(65) Prior Publication Data

US 2026/0049542 A1 Feb. 19, 2026

(51) Int. Cl.
*E21B 43/12* (2006.01)

(52) U.S. Cl.
CPC ..... *E21B 43/123* (2013.01); *Y10T 137/2934* (2015.04)

(58) Field of Classification Search
CPC ..... Y10T 137/2934; E21B 43/123; E21B 34/102; E21B 34/103; F04B 5/00
(Continued)

(56) References Cited

U.S. PATENT DOCUMENTS 1,738,974 A * 12/1929 Taylor ..... E21B 34/06 137/155
1,806,872 A * 5/1931 Boynton ..... E21B 34/10 417/115

(Continued)

FOREIGN PATENT DOCUMENTS

EP 2666957 A2 11/2013
WO WO 2004031529 4/2004

(Continued)

OTHER PUBLICATIONS

BOTIL; Gas Lift Equipment Catalogue; www.botilindia.com; date unknown.

(Continued)

*Primary Examiner* — Jessica Cahill
(74) *Attorney, Agent, or Firm* — Baker Hughes Patent Organization

(57) ABSTRACT

An unloading valve for use in evacuating fluids from a wellbore annulus. The unloading valve can include a valve body, an intake to the valve body, a discharge from the valve body, and an induced pressure differential valve control system configured to automatically close the intake to the valve body in response to a change in the density of fluids passing through the unloading valve. In some embodiments, the induced pressure differential valve control system includes a flow sleeve, a valve element, a draw tube and a biasing spring. The flow sleeve includes a flow constriction that produces a pressure differential (AP) as the fluids pass through the flow sleeve that is communicated by the draw tube to the valve element. The biasing spring is configured to urge the valve element into a closed position when the pressure differential (AP) falls below a threshold value.

8 Claims, 5 Drawing Sheets

(58) Field of Classification Search
USPC ..... 166/323
See application file for complete search history.

(56) References Cited

U.S. PATENT DOCUMENTS

| | | | | |
|---|---|---|---|---|
| 1,884,548 | A * | 10/1932 | Boynton | E21B 43/123 137/155 |
| 2,649,272 | A | 8/1953 | Barbato | |
| 2,845,940 | A | 8/1958 | Garrett et al. | |
| 3,160,113 | A | 12/1964 | Meyers | |
| 3,381,708 | A * | 5/1968 | Chenoweth | F16K 3/265 137/504 |
| 3,521,977 | A * | 7/1970 | Chenoweth | E21B 43/123 417/115 |
| 3,646,953 | A | 3/1972 | Elliott et al. | |
| 3,654,949 | A | 4/1972 | Mcmurry | |
| 3,863,961 | A | 2/1975 | Dinning | |
| 3,874,445 | A | 4/1975 | Terral | |
| 3,888,273 | A | 6/1975 | Douglas | |
| 4,035,103 | A | 7/1977 | Mcmurry et al. | |
| 4,295,795 | A | 10/1981 | Gass et al. | |
| 4,295,796 | A | 10/1981 | Moore | |
| 4,437,487 | A | 3/1984 | Marmon | |
| 4,505,331 | A | 3/1985 | Akkerman | |
| RE32,441 | E | 6/1987 | Higgins et al. | |
| 4,685,523 | A | 8/1987 | Paschal et al. | |
| 4,722,393 | A | 2/1988 | Rumbaugh | |
| 5,176,164 | A | 1/1993 | Boyle | |
| 5,181,566 | A | 1/1993 | Barneck | |
| 5,535,767 | A | 7/1996 | Schnatzmeyer et al. | |
| 5,971,004 | A * | 10/1999 | Pringle | E21B 34/066 137/155 |
| 6,070,608 | A | 6/2000 | Pringle | |
| 6,148,843 | A | 11/2000 | Pringle | |
| 6,206,645 | B1 | 3/2001 | Pringle | |
| 6,375,155 | B1 | 4/2002 | Janssens | |
| 6,679,332 | B2 | 1/2004 | Vinegar et al. | |
| 6,722,632 | B2 | 4/2004 | Kenny et al. | |
| 7,213,607 | B2 | 5/2007 | De | |
| 7,228,909 | B2 | 6/2007 | Schmidt et al. | |
| 7,658,229 | B2 | 2/2010 | Becker et al. | |
| 8,162,060 | B2 | 4/2012 | Randazzo | |
| 8,453,736 | B2 | 6/2013 | Constantine | |
| 8,714,264 | B2 | 5/2014 | Fay | |
| 8,881,825 | B2 | 11/2014 | White et al. | |
| 9,057,243 | B2 | 6/2015 | Hendel et al. | |
| 9,453,397 | B2 | 9/2016 | Dowling et al. | |
| 9,453,398 | B1 | 9/2016 | Zhang et al. | |
| 9,587,463 | B2 | 3/2017 | Tveiten et al. | |
| 10,655,439 | B2 | 5/2020 | Murdoch et al. | |
| 10,677,028 | B2 | 6/2020 | Oliphant | |
| 10,787,889 | B2 | 9/2020 | Salihbegovic et al. | |
| 10,830,012 | B2 | 11/2020 | Holmes et al. | |
| 2001/0017157 | A1 | 8/2001 | Pringle | |
| 2002/0020533 | A1 | 2/2002 | Tubel | |
| 2002/0029883 | A1 | 3/2002 | Vinegar et al. | |
| 2006/0137881 | A1 | 6/2006 | Schmidt et al. | |
| 2007/0181312 | A1 | 8/2007 | Kritzler et al. | |
| 2008/0135255 | A1 | 6/2008 | Coronado et al. | |
| 2009/0056952 | A1 * | 3/2009 | Churchill | E21B 21/10 166/373 |
| 2009/0255592 | A1 * | 10/2009 | Caccialupi | E21B 34/103 137/498 |
| 2011/0036591 | A1 | 2/2011 | George et al. | |
| 2011/0083855 | A1 | 4/2011 | Wygnanski | |
| 2012/0292034 | A1 | 11/2012 | Fay | |
| 2013/0094975 | A1 * | 4/2013 | Stokka | E21B 43/123 417/54 |
| 2013/0146155 | A1 | 6/2013 | Gilbertson et al. | |
| 2013/0220599 | A1 | 8/2013 | Rae | |
| 2013/0220628 | A1 | 8/2013 | Tran | |
| 2014/0352982 | A1 | 12/2014 | White et al. | |
| 2016/0290099 | A1 | 10/2016 | Balasubramanian | |
| 2017/0089175 | A1 | 3/2017 | Doane et al. | |
| 2020/0032592 | A1 | 1/2020 | Romer et al. | |
| 2021/0131238 | A1 | 5/2021 | Stojkovic et al. | |
| 2022/0162928 | A1 | 5/2022 | Harestad | |
| 2023/0041355 | A1 | 2/2023 | Brown et al. | |
| 2023/0272685 | A1 | 8/2023 | Dave et al. | |

FOREIGN PATENT DOCUMENTS

| | | | | |
|---|---|---|---|---|
| WO | 2014022121 | A1 | 2/2014 | |
| WO | 2016049726 | A1 | 4/2016 | |
| WO | WO-2022173815 | A1 * | 8/2022 | E21B 43/1235 |

OTHER PUBLICATIONS

ISA/US International Search Report and Written Opinion for PCT/US2023/018723 mailed Aug. 15, 2023.

"MMRG Series Side Pocket Mandrels", Schlumberger, MMRG Series Side Pocket Mandrels, Sales Brochure, 2015.

"Side Pocket Mandrels", Parveen Industries Pvt. Ltd., Side Pocket Mandrels; www.parveen.in/products/side-pocket-mandrels; webpage captured Jul. 29, 2022.

Abdalsadig, Mohamed , et al., "Gas Lift Optimization Using Smart Gas Lift Valve", Abdalsadig et al., Gas Lift Optimization Using Smart Gas Lift Valve; World Academy of Science, Engineering and Technology International Journal of Mechanical and Mechatronics Engineering, vol. 10, No. 6, 2016.

Schlumberger , "Side Pocket Mandrels—Reliable Gas Lift with Flexibility for the Future; 17-AL-291763", Jan. 1, 2017.

Schlumberger , "SO2-30R-B Dual-Check Shear Orifice Gas Lift Valve", Schlumberger; SO2-30R-B Dual-Check Shear Orifice Gas Lift Valve; 2011, Jan. 1, 2011.

Schlumberger , "WRFC-H Wireline-retrievable flow control valve for gas lift applications", Schlumberger; WRFC-H Product Brochure; 09-CO-0263; 2010, Jan. 1, 2010.

Schnatzmeyer, M.A. , et al., "Development of a Surface-Controlled Electric Gas-Lift Valve", Journal of Petroleum Technology, May 1, 1994, May 1, 1994.

Zhiyue, Xu , et al., "Smart Gas Lift Valves Eliminate Multiple Slickline Trips in Gas Lift Operations", Zhiyue, et al., Smart Gas Lift Valves Eliminate Multiple Slickline Trips in Gas Lift Operations, Offshore Technology Conference Asia, 2014.

* cited by examiner

VENTURI CONTROLLED UNLOADING VALVE FOR GAS LIFT SYSTEM

FIELD OF THE INVENTION

This invention relates generally to the field of oil and gas production, and more particularly to a gas lift system that incorporates an improved unloading valve.

BACKGROUND

Gas lift is a technique in which gaseous fluids are injected into the tubing string from the surrounding annulus to reduce the density of the produced fluids to allow the formation pressure to push the less dense mixture to the surface. The gaseous fluids can be injected into the annulus from the surface. A series of gas lift valves allow access from the annulus into the production tubing. The gas lift valves can be configured to automatically open when the pressure gradient between the annulus and the production tubing exceeds the closing force holding each gas lift valve in a closed position.

In most installations, the gas lift valves are contained within side pocket mandrels, which provide a laterally offset valve pocket that secures the gas lift valve while providing access to lower components in the equipment string. Each of the gas lift mandrels within the gas lift system can be deployed above a packer or other zone isolation device to ensure that liquids and wellbore fluids do not interfere with the operation of the gas lift valve. The side pocket mandrels can include "unloading" valves designed to evacuate annular liquids or "operating" valves that conduct pressurized gas into the tubing string.

Before the standard operating valves can be used to recover petroleum fluids from the well, it may be necessary to use a series of unloading valves to remove completion or wellbore fluids from the annulus to reveal the operating gas lift valves. Unloading valves are particularly helpful in installations where the gas lift compressor is unable to provide sufficient gas pressures or volumes to actuate operating valves placed deep in the well. Once the unloading valves are no longer submerged within a column of liquid in the annulus, the unloading valves are designed to close so that the injected gas is forced deeper into the well toward the operating valves. By sequentially actuating a series of unloading valves in the upper portions of the well, the compressor can then apply sufficient pressure to the remaining fluid column in the annulus to actuate the operating valves.

Conventional unloading valves are sometimes referred to as "injection operating pressure" or "IPO" valves. These IPO valves include an internal valve mechanism in which a nitrogen-charged compressible bellows presses a valve member against a valve seat within the unloading valve. As the bellows compress under pressure from the annulus, the valve member lifts off the valve seat to permit the flow of annular fluids through the unloading valve. Although generally effective, the bellows mechanisms are only reliable under a limited range of pressures. Increasingly, there is a need for an unloading valve that can operate under pressures that exceed the limits of conventional bellows-based unloading valves. The present disclosure is directed to these and other deficiencies in the prior art.

SUMMARY OF THE INVENTION

In one aspect, embodiments disclosed herein include an unloading valve for use in evacuating fluids from a wellbore annulus. The unloading valve can include a valve body, an intake to the valve body, a discharge from the valve body, and an induced pressure differential valve control system configured to automatically close the intake to the valve body in response to a change in the density of fluids passing through the unloading valve.

In another aspect, the present disclosure is directed to an unloading valve for use in evacuating fluids from a wellbore annulus, where the unloading valve includes a valve body, an intake to the valve body, a discharge from the valve body, and an induced pressure differential valve control system configured to automatically close the intake to the valve body in response to a change in the density of fluids passing through the unloading valve. In these embodiments, the induced pressure differential valve control system includes a flow sleeve, a valve element, a draw tube and a biasing spring. The flow sleeve includes an inlet adjacent to the intake, an outlet adjacent the discharge, and a flow constriction in the flow sleeve that produces a pressure differential ($\Delta P$) as the fluids pass through the flow sleeve. The valve element is configured to move from an open position to a closed position blocking the inlet. The draw tube communicates the pressure differential ($\Delta P$) to the valve element. The biasing spring is attached to the first end of the valve element and configured to urge the valve element into the closed position against a force resulting from the pressure differential ($\Delta P$).

WRITTEN DESCRIPTION

As used herein, the term "petroleum" refers broadly to all mineral hydrocarbons, such as crude oil, gas and combinations of oil and gas. The term "fluid" refers generally to both gases and liquids, and "two-phase" or "multiphase" refers to a fluid that includes a mixture of gases and liquids. "Upstream" and "downstream" can be used as positional references based on the movement of a stream of fluids from an upstream position in the wellbore to a downstream position on the surface. Although embodiments of the present invention may be disclosed in connection with a conventional well that is substantially vertically oriented, it will be appreciated that embodiments may also find utility in horizontal, deviated or unconventional wells.

Figure 1:
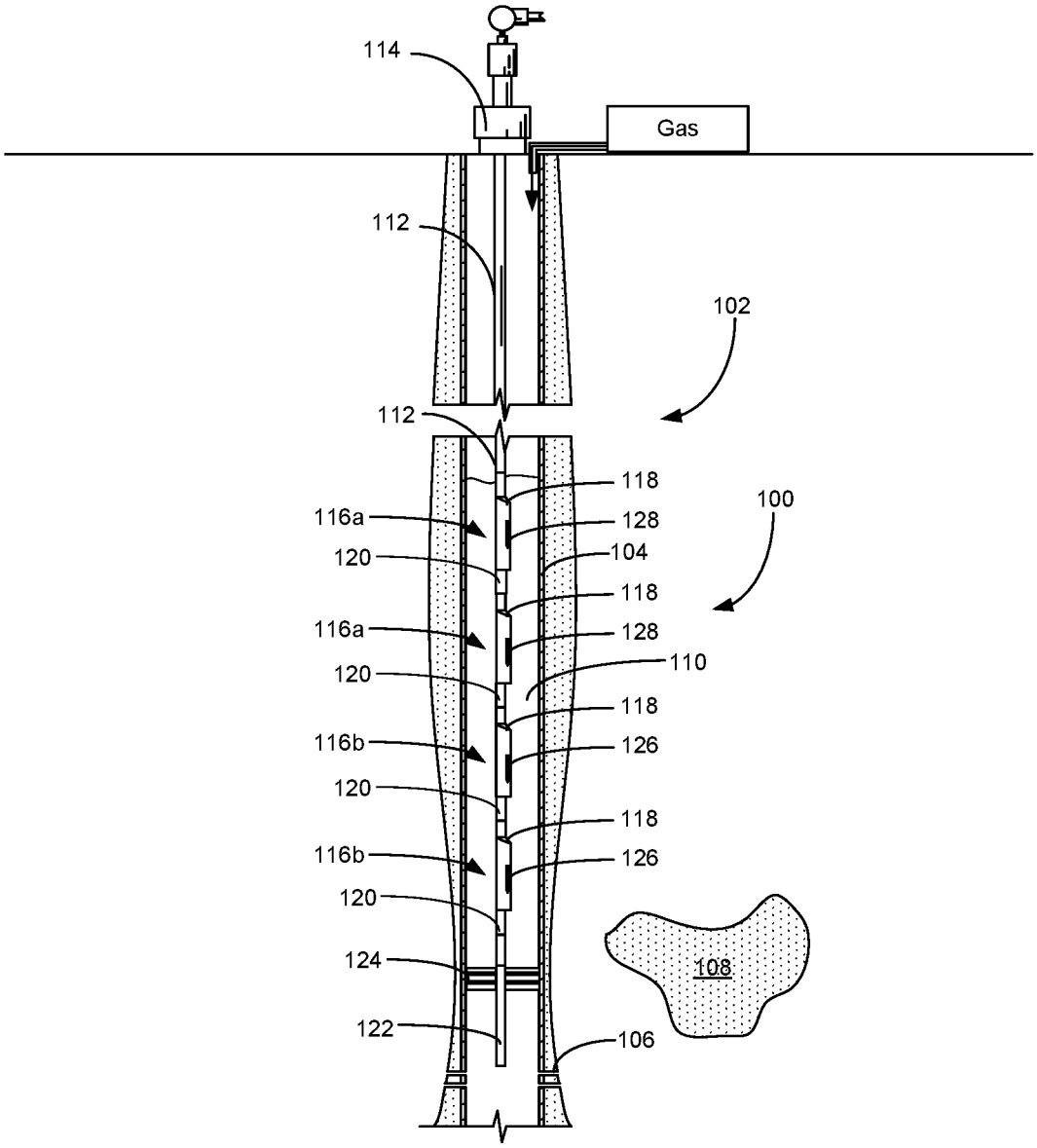
FIG. 1 is a side view of a gas lift system deployed in a conventional well.

Turning to FIG. 1, shown therein is a gas lift system 100 disposed in a well 102. The well 102 includes a casing 104 and a series of perforations 106 that admit wellbore fluids from a producing geologic formation 108 through the casing 104 into the well 102. An annular space or "annulus" 110 is formed between the gas lift system 100 and the casing 104. The gas lift system 100 is connected to tubing string 112 (also referred to as "production tubing") that conveys produced wellbore fluids from the formation 108, through the gas lift system 100, to a wellhead 114 on the surface.

The gas lift system 100 includes one or more gas lift modules 116 (four are shown in FIG. 1). The gas lift modules 116 each include a side pocket mandrel 118, which may be connected to a pup joint 120. An inlet pipe 122 extends through one or more packers 124 into a lower zone of the well 102 closer to the perforations 106. In this way, produced fluids are carried through the inlet pipe 122 into the lowermost (upstream) gas lift module 116. The produced fluids are carried through the gas lift system 100 and the tubing string 112, which conveys the produced fluids through the wellhead 114 to surface-based storage or processing facilities.

The gas lift modules 116 can include an operating valve 126 or an unloading valve 128. In the illustrative embodiment depicted in FIG. 1, the upper gas lift modules 116*a* each include an unloading valve 128 and the lower gas lift modules 116*b* each include an operating valve 126. It will be appreciated that the gas lift system 100 can include fewer or additional gas lift modules 116, with each gas lift module 116 including an operating valve 126, an unloading valve 128 or a combination of operating and unloading valves 126, 128.

The upper gas lift modules 116*a* are well positioned to unload fluid in the annulus 110 above the lower gas lift modules 116*b* to permit the efficient operation of the operating valves 126. In accordance with well-established gas lift principles, pressurized fluids or gases are injected from the surface into the annulus 110 surrounding the gas lift system 100. During an initial unloading stage, the pressure applied from the surface forces the annular fluid through open unloading valves 128 in the upper gas lift modules 116*a* to evacuate excess fluid in the annulus 110.

Once a sufficient volume of fluid in the annulus 110 has been removed and the unloading valves 128 have returned to a closed state, the lower gas lift modules 116*b* can be actuated by modulating the pressure gradient between the annulus 110 (PA) and the tubing string 112 (PT) to open the operating valves 126 to admit the pressurized gases into the tubing string 112 through the side pocket mandrels 118 of the lower gas lift modules 116*b*. The pressurized gases combine with the produced fluids in the gas lift modules 116 to reduce the overall density of the fluid, which facilitates the recovery of the produced fluids from the well 102. The gas lift system 100 may find utility in recovering liquid and multiphase hydrocarbons, as well as recovering brine and other water-based fluids from the well 102.

Figure 2:
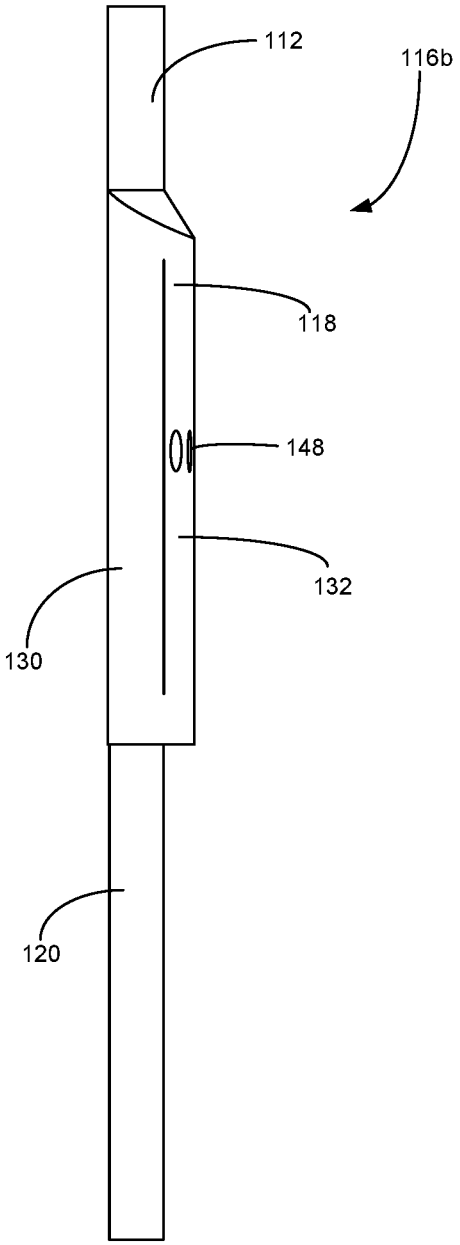
FIG. 2 is a side view of a side pocket mandrel constructed in accordance with an embodiment of the invention.
Figure 3:
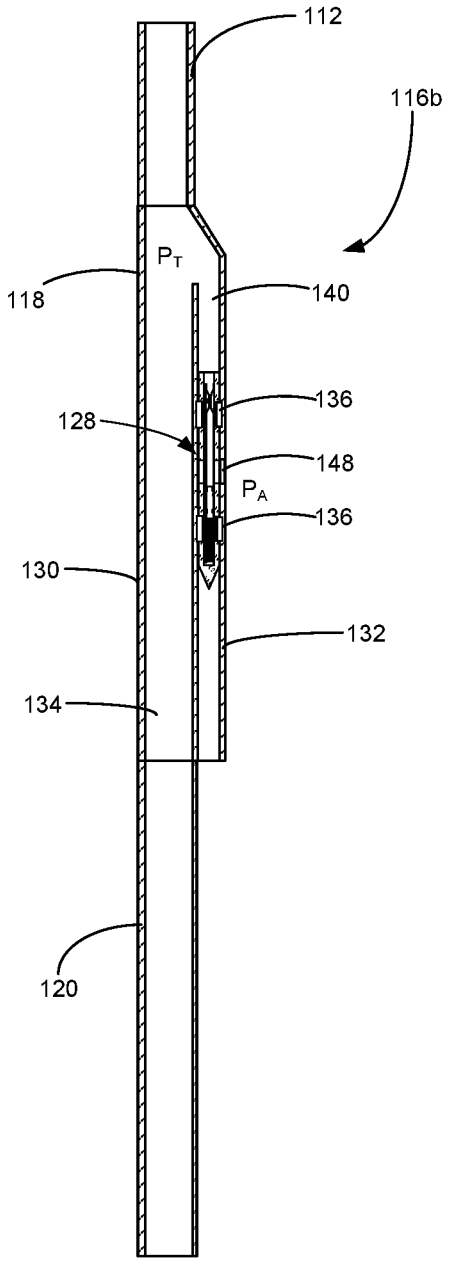
FIG. 3 is a side cross-sectional view of the side pocket mandrel of FIG. 2 with a venturi controlled unloading valve.

Turning to FIGS. 2-3, shown therein are side and cross-sectional views, respectively, of the gas lift module 116 with the unloading valve 128. As best illustrated in the cross-sectional view in FIG. 3, the side pocket mandrel 118 includes a central body 130 and a valve pocket 132 within the side pocket mandrel 118. The central body 130 includes a central bore 134. The valve pocket 132 is laterally offset and partially separated from the central bore 134. The unloading valve 128 is retrievably retained by a latch mechanism 136 within the valve pocket 132. In some embodiments, the unloading valve 128 can be installed and retrieved using a wireline-supported kickover tool. The unloading valve 128 is designed to permit the efficient evacuation of liquids and denser multiphase fluids through the upper gas lift module 116*b*.

Figure 4:
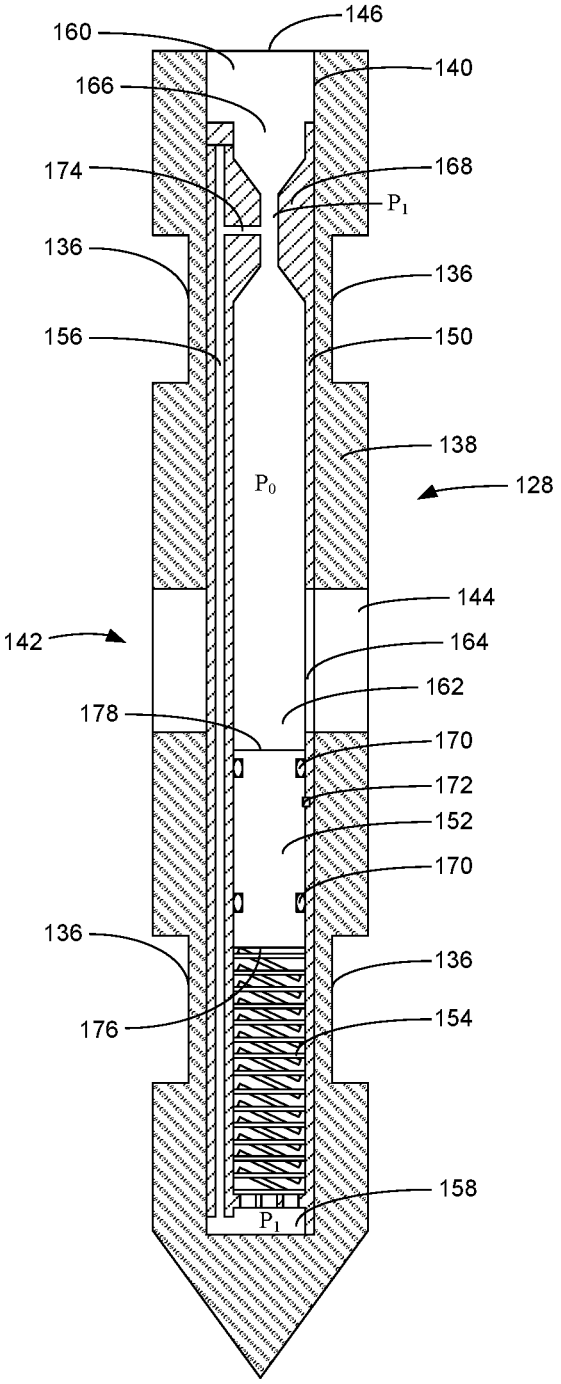
FIG. 4 is a cross-sectional view of the unloading valve of FIG. 3 in a first state.

Turning to FIG. 4, shown therein is a simplified cross-sectional view of the unloading valve 128. The unloading valve 128 includes an unloading valve body 138, a central channel 140 inside the valve body 138, an induced pressure differential valve control system 142, an intake 144 and a discharge 146. The intake 144 extends through the valve body 138 and is aligned with an external port 148 on the side pocket mandrel 118 (shown in FIGS. 2-3) to place the unloading valve 128 in fluid communication with the annulus 110.

The induced pressure differential valve control system 142 includes a flow sleeve 150 inside the central channel 140, a valve element 152, a biasing spring 154, and a draw tube 156. The flow sleeve 150 includes a first end 158, a second end 160, an interior section 162 between the first end 158 and the second end 160, an inlet 164, an outlet 166 and a flow constriction 168. In the embodiment depicted in FIG. 4, the inlet 164 to the flow sleeve 150 is adjacent the intake 144 of the unloading valve 128. The flow sleeve 150 can be integrated into the central channel 140 or presented as a separate component that is secured by welding or other means within the central channel 140.

Figure 7:
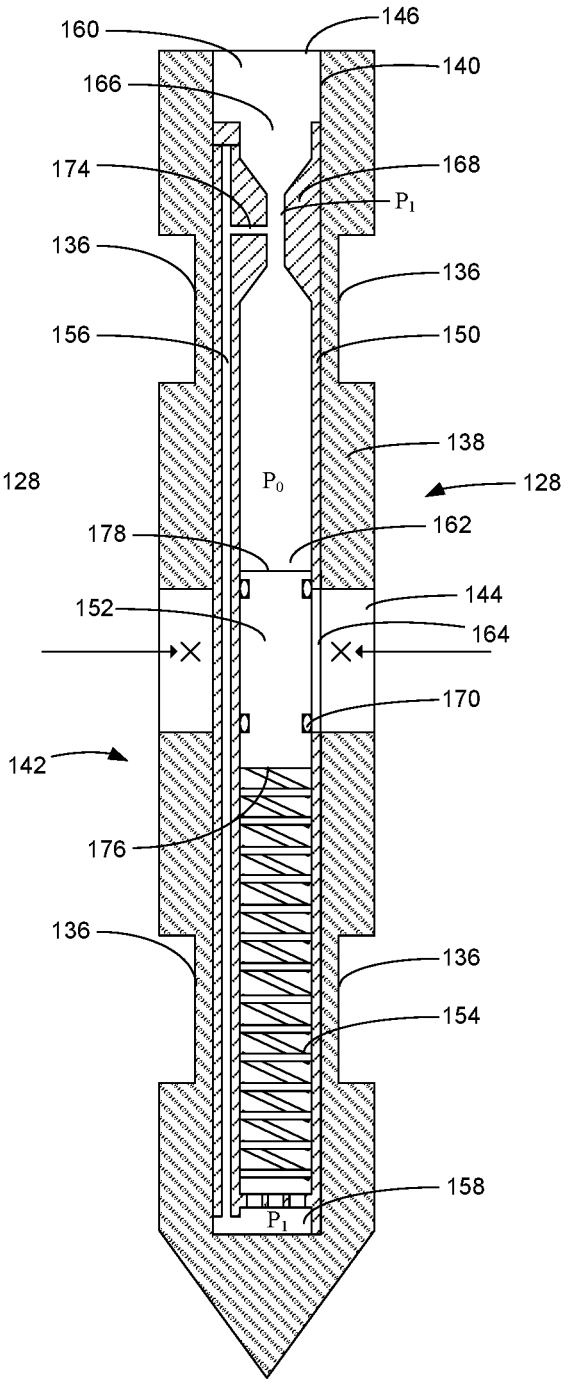
FIG. 7 is a cross-sectional view of the unloading valve in a fourth state.

In some embodiments, the valve element 152 is a substantially cylindrical piston with a first end 176 and a second end 178. The valve element 152 can include seals 170 that provide a tight clearance within the flow sleeve 150, while permitting the valve element 152 to reciprocate within the interior portion 162 of the flow sleeve 150. The first end 176 of the valve element 152 is attached to the biasing spring 154, which is in turn captured near the first end 158 of the flow sleeve 150. The biasing spring 154 is sized and configured to exert a spring force against the valve element 152 to urge the valve element 152 into an occluding position relative to the intake 144 and inlet 164 to block fluid from entering the unloading valve 128 (as depicted in FIG. 7).

The valve element 152 can be held in an initial installation position by a releasable locking pin or shear pin 172. When the pin 172 is sheared, released or withdrawn, the valve element 152 is permitted to move in a reciprocating linear manner within the flow sleeve 150.

The flow constriction 168 has a smaller cross-sectional area than the adjacent portions of the flow sleeve 150. The flow constriction 168 thus forms a "throat" within the flow sleeve 150. As fluid passes enters the flow sleeve 150, the fluid has an inlet pressure ($P_0$) at the inlet 164. As the fluid accelerates through the flow constriction 168, the pressure decreases in accordance with conservation of energy principles, which are sometimes referred to as the Venturi effect. The flow constriction 168 therefore produces a reduced constriction pressure ($P_1$) that is less than the initial pressure ($P_0$). The pressure differential ($P_0$-$P_1$ or $\Delta P$) increases with fluid density and flow rate through the unloading valve 128.

The constriction pressure ($P_1$) inside the flow constriction 168 is communicated to the draw tube 156 through a suction communication port 174. The draw tube 156 is laterally offset from the flow sleeve 150 and extends from the flow constriction 168 to the first end 158 of the flow sleeve 150. The draw tube 156 thereby communicates the constriction pressure ($P_1$) from the flow constriction 168 to the first end 158 of the flow sleeve 150 and the first side end of the valve element 152. As illustrated in FIG. 4, the second end 178 of the valve element 152 is exposed to the inlet pressure ($P_0$). This creates a pressure differential ($\Delta P$) across the valve element 152 between the larger inlet pressure ($P_0$) and the smaller constriction pressure ($P_1$) with a variable resultant force based in part on the density of fluid passing through the flow constriction 168. The pressure differential ($\Delta P$) generally decreases with a corresponding decrease in the density of the fluid passing through the unloading valve 128. Thus, as the well 102 is unloaded and the denser liquids passing through the unloading valve 128 are replaced by lighter gases, the pressure differential (ΔP) created by the flow constriction and applied to the valve element 152 decreases until it is overcome by the closing force applied by the biasing spring 154.

The biasing spring 154 can be calibrated to urge the valve element 152 into a "closed state" when the pressure differential (ΔP) created by fluids passing through the unloading valve 128 falls below a closing pressure differential ($\Delta P_1$), at which the closing force applied by the biasing spring 154 overcomes the closing pressure differential ($\Delta P_1$). Until the closing pressure differential ($\Delta P_1$) is reached, the force applied by the biasing spring 154 should be insufficient to overcome an unloading pressure differential ($\Delta P_0$) generated by the evacuation of liquids through the unloading valve 128 that exceed threshold densities and flow rates. As explained above, the unloading pressure differential ($\Delta P_0$) will decrease as the well 102 is unloaded because the denser liquids initially present in the annulus 110 are gradually replaced with lighter gases injected from the surface.

In FIG. 4, the valve element 152 is retained in the "open state" by the shear pin 172. When the unloading operation begins, the pressurized gases injected into the annulus 110 force the dense fluids in the annulus 110 to enter the unloading valve 128 through the external port 148. The flow of dense fluids through the unloading valve 128 produces a significant initial pressure differential ($\Delta P_0$) across the valve element 152 that pulls the valve element 152 toward the first end 158 against the force exerted by the biasing spring 154. The movement of the valve element 152 breaks or releases the shear pin 172 to allow the valve element 152 to thereafter reciprocate in the flow sleeve 150.

Figure 5:
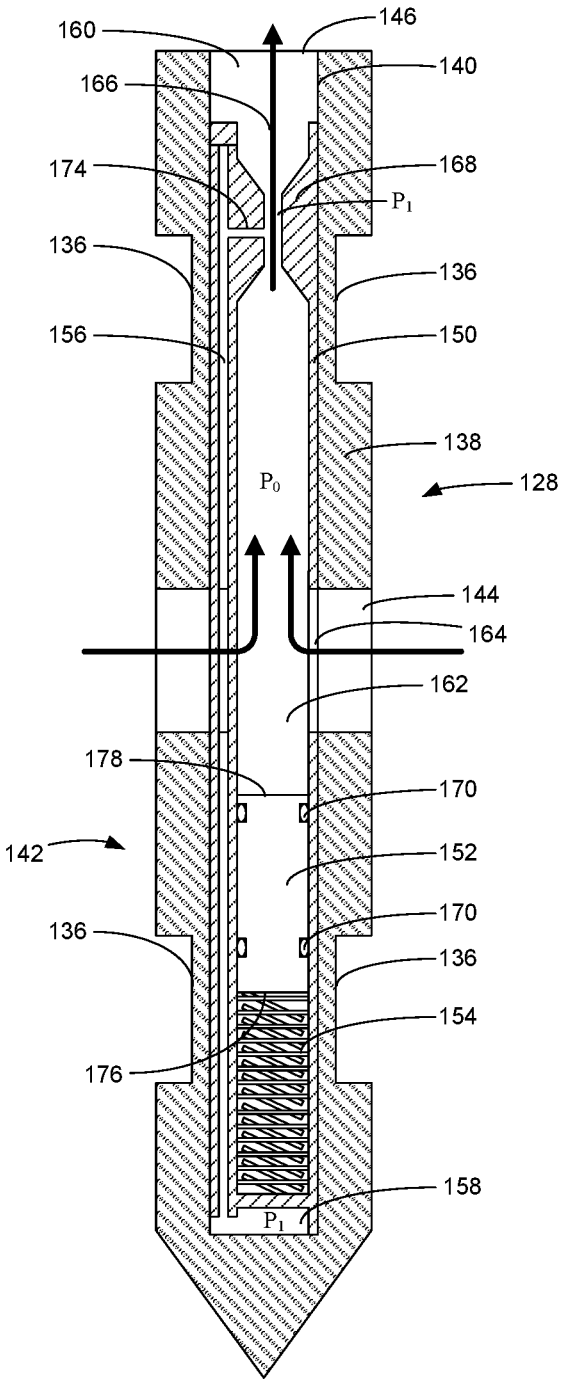
FIG. 5 is a cross-sectional view of the unloading valve in a second state.

As depicted in FIG. 5, the continued flow of dense fluids through the unloading valve 128 and resulting pressure differential ($\Delta P_0$) applied to the valve element 152 maintains the valve element 152 in the "open state," to permit the passage of fluids from the annulus 110 into the tubing string 112 through the unloading valve 128. The fluids are discharged from the unloading valve 128 into the tubing string 112 through the side pocket mandrel 118.

Figure 6:
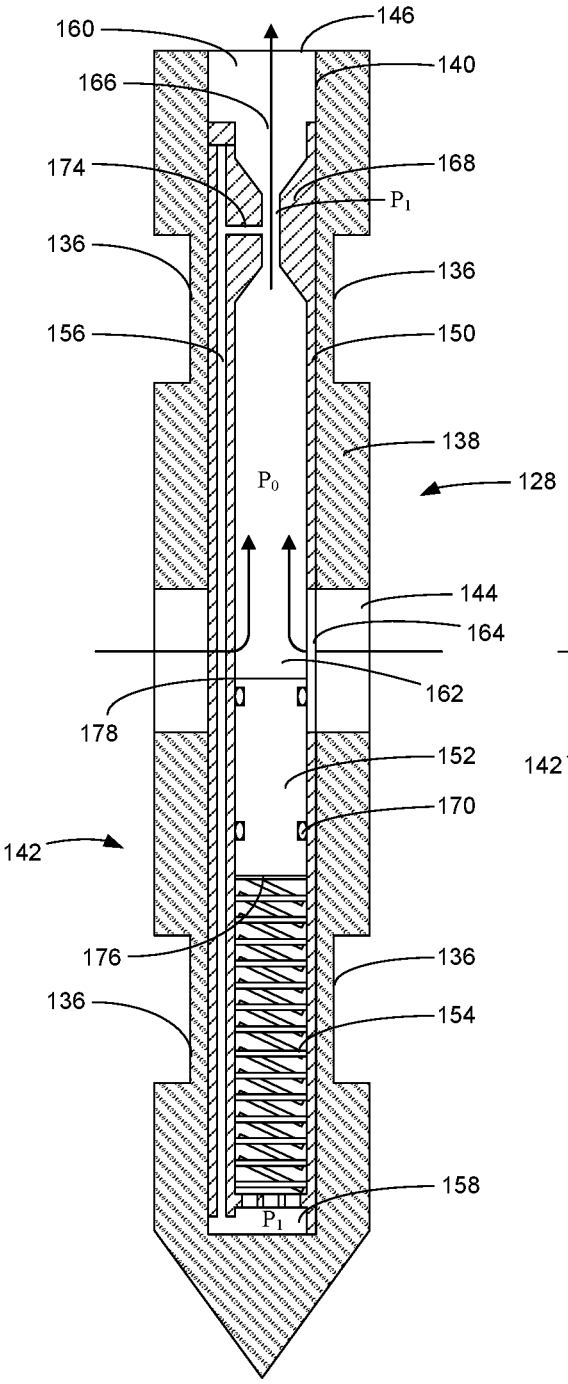
FIG. 6 is a cross-sectional view of the unloading valve in a third state.

As the well 102 is unloaded, the fluid passing through the unloading valve 128 transitions from primarily liquid to a multiphase fluid characterized by a mixture of gases and liquids. As the density of the fluid inside the unloading valve 128 decreases, the pressure differential (ΔP) applied to the valve element 152 also decreases, which allows the biasing spring 154 to urge the valve element 152 upward toward the interior portion 162 of the flow sleeve 150. FIG. 6 depicts the movement of the valve element 152 into a "partially closed state" in which the valve element 152 partially occludes the inlet 164.

As flow through the unloading valve 128 continues to transition toward lighter, less dense gases injected from the surface, the pressure differential (ΔP) applied to the valve element 152 continues to decrease until it falls below the closing pressure differential ($\Delta P_1$) and is overcome by the force applied by the biasing spring 154 to the valve element 152. When the fluid passing through the unloading valve 128 produces a pressure differential that falls below the closing pressure differential ($\Delta P_1$), the biasing spring 154 forces the valve element 152 into a "closed state" in which the valve element 152 blocks the inlet 164 to prevent the passage of fluids into the unloading valve 128.

Thus, unlike prior art unloading valves that rely on a nitrogen-charged bellows to control the displacement of the internal valve element, the induced pressure differential valve control system 142 controls the passage of fluids through the unloading valve 128 in response to a variable pressure differential (ΔP) created by the passage of fluids from the annulus 110 through the flow constriction 168.

Once the closing pressure differential ($\Delta P_1$) has been reached, the biasing spring 154 will hold the valve element 152 in the closed position to prevent gases from entering the unloading valve 128. This permits the gases injected into the annulus 110 to reach unloading valves 128 and operating valves 126 located deeper in the well 102. Once the well 102 has been sufficiently unloaded, the injected gases can be admitted into the tubing string 112 through the operating valves 126 to aid in the recovery of petroleum products in accordance with established gas lift recovery techniques.

Figure 8:
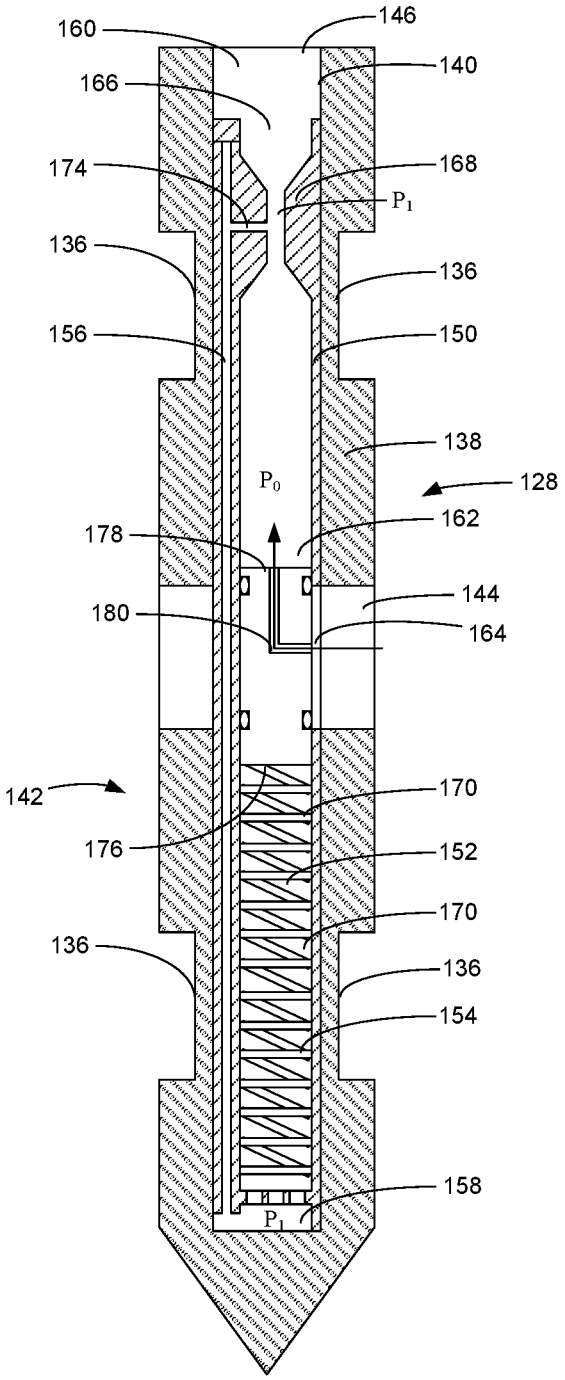
FIG. 8 is a cross-sectional view of the unloading valve with an alternate valve element.

Turning to FIG. 8, shown therein is an alternate embodiment in which the valve element 152 includes a bypass channel 180. The bypass channel 180 permits a portion of fluid to bypass the valve element 152 when it is in the "closed state." This can be useful for reopening the unloading valve 128 in the event the valve element 152 was placed into the closed position by a transient gas event, or if the annulus 110 refills with liquids or denser multiphase fluids. If sufficiently dense fluids enter the flow sleeve 150 through the bypass channel 180, the fluids will produce a pressure differential (ΔP) that can retract the valve element 152 against the force applied by the biasing spring 154 to return the unloading valve 128 back into an "open state."

The induced pressure differential valve control system 142 of the unloading valve 128 represents a significant and important development that overcomes many of the deficiencies of standard opening valves that rely on nitrogen-charged bellows. In particular, because the induced pressure differential valve control system 142 automatically closes the unloading valve 128 in response to a change in the density of fluids passing through the unloading valve 128, the unloading valve 128 can be easily calibrated to automatically close upon the successful evacuation of the denser fluids in the annulus 110 near the applicable gas lift module 116.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. An unloading valve for use in evacuating fluids from a wellbore annulus, the unloading valve comprising:

a valve body;

an intake to the valve body;

a discharge from the valve body; and an induced pressure differential valve control system configured to automatically close the intake to the valve body in response to a change in the density of fluids passing through the unloading valve, wherein the induced pressure differential valve control system comprises:

a flow sleeve;

a valve element configured for linearly reciprocating movement within the flow sleeve between an open position and a closed position, wherein the valve element is substantially cylindrical with first and second ends;

a flow constriction in the flow sleeve that produces a pressure differential (AP) as the fluids pass through the flow sleeve;

a draw tube that communicates the pressure differential (AP) to the valve element;

a biasing spring attached to the first end of the valve element; and a pin that secures the valve element in an initial open position.

2. The unloading valve of claim 1, wherein the biasing spring is configured to move the valve element into the closed position when the pressure differential (ΔP) across the valve element falls below a closing pressure differential ($\Delta P_1$).

3. The unloading valve of claim 1, wherein the biasing spring is configured to keep the valve element in the open position when the pressure differential (ΔP) across the valve element exceeds a closing pressure differential ($\Delta P_1$).

4. An unloading valve for use in evacuating fluids from a wellbore annulus, the unloading valve comprising:

a valve body;

an intake to the valve body;

a discharge from the valve body; and an induced pressure differential valve control system configured to automatically close the intake to the valve body in response to a change in the density of fluids passing through the unloading valve, wherein the induced pressure differential valve control system comprises:

a flow sleeve that comprises:

an inlet adjacent to the intake;

an outlet adjacent the discharge; and a flow constriction in the flow sleeve that produces a pressure differential (ΔP) as the fluids pass through the flow sleeve;

a valve element configured to move from an open position to a closed position blocking the inlet;

a draw tube that communicates the pressure differential (ΔP) to the valve element;

a biasing spring attached to the first end of the valve element and configured to urge the valve element into the closed position against a force resulting from the pressure differential (ΔP); and a pin that secures the valve element in an initial open position.

5. The unloading valve of claim 4, wherein the biasing spring is configured to move the valve element into the closed position when the pressure differential (ΔP) across the valve element falls below a closing pressure differential ($\Delta P_1$).

6. The unloading valve of claim 4, wherein the biasing spring is configured to keep the valve element in the open position when the pressure differential (ΔP) across the valve element exceeds a closing pressure differential ($\Delta P_1$).

7. An unloading valve for use in evacuating fluids from a wellbore annulus, the unloading valve comprising:

a valve body;

an intake to the valve body;

a discharge from the valve body; and an induced pressure differential valve control system configured to automatically close the intake to the valve body in response to a change in the density of fluids passing through the unloading valve, wherein the induced pressure differential valve control system comprises:

a flow sleeve;

a valve element configured for linearly reciprocating movement within the flow sleeve between an open position and a closed position, wherein the valve element is substantially cylindrical with first and second ends and wherein the valve element comprises a bypass channel;

a flow constriction in the flow sleeve that produces a pressure differential (AP) as the fluids pass through the flow sleeve;

a biasing spring attached to the first end of the valve element; and a draw tube that communicates the pressure differential (AP) to the valve element.

8. An unloading valve for use in evacuating fluids from a wellbore annulus, the unloading valve comprising:

a valve body;

an intake to the valve body;

a discharge from the valve body; and an induced pressure differential valve control system configured to automatically close the intake to the valve body in response to a change in the density of fluids passing through the unloading valve, wherein the induced pressure differential valve control system comprises:

a flow sleeve that comprises:

an inlet adjacent to the intake;

an outlet adjacent the discharge; and a flow constriction in the flow sleeve that produces a pressure differential (ΔP) as the fluids pass through the flow sleeve;

a valve element configured to move from an open position to a closed position blocking the inlet, wherein the valve element comprises a bypass channel;

a draw tube that communicates the pressure differential (ΔP) to the valve element;

a biasing spring attached to the first end of the valve element and configured to urge the valve element into the closed position against a force resulting from the pressure differential (ΔP).

* * * * *